US005853971A

United States Patent [19]

Bell et al.

[11] Patent Number: 5,853,971

[45] Date of Patent: Dec. 29, 1998

[54] COLOR PHOTOGRAPHIC SILVER HALIDE MATERIAL

[75] Inventors: Peter Bell, Köln; Hans-Ulrich Borst, Elsdorf; Ralf Büscher, Lohmar; Johannes Willsau; Jörg Siegel, both of Leverkusen, all of Germany

[73] Assignee: Agfa-Gevaert AG, Germany

[21] Appl. No.: 838,084

[22] Filed: Apr. 15, 1997

[30] Foreign Application Priority Data

Apr. 25, 1996 [DE] Germany ..... 196 16 497.4

[51] Int. Cl.[6] ..... G03C 1/83

[52] U.S. Cl. ..... 430/555; 430/517; 430/554; 430/558; 430/559

[58] Field of Search ..... 430/554, 555, 430/558, 559, 517

[56] References Cited

U.S. PATENT DOCUMENTS

| | | | |
|---|---|---|---|
| 3,869,291 | 3/1975 | Mader et al. | 430/555 |
| 4,186,011 | 1/1980 | Lohmann et al. | 430/505 |
| 4,427,763 | 1/1984 | Lohmann et al. | 430/555 |
| 4,749,641 | 6/1988 | Kaufman et al. | 430/555 |
| 5,364,745 | 11/1994 | Mooberry et al. | 430/562 |
| 5,492,799 | 2/1996 | Kapp et al. | 430/558 |

*Primary Examiner*—Hoa Van Le
*Attorney, Agent, or Firm*—Connolly & Hutz

[57] ABSTRACT

A color photographic silver halide material contains on a support at least one red-sensitive, cyan-coupling, at least one green-sensitive, magenta-coupling and at least one blue-sensitive, yellow-coupling silver halide emulsion layer together with interlayers between layers of different colour sensitivity, wherein at least one of the stated interlayers contains at least one masking coupler, the masking coupler having a reaction rate constant for the coupling reaction with the developer oxidation product of $\geqq 5000$ 1-mol$^{-}$•s$^{-1}$, is distinguished improved sensitivity without increase of granularity.

11 Claims, No Drawings

COLOR PHOTOGRAPHIC SILVER HALIDE MATERIAL

This invention relates to a colour photographic silver halide material, the sensitivity of which is improved without increase of granularity by the purposeful use of a certain masking coupler.

In a colour photographic material, the actual colour couplers, which are themselves colourless, are responsible for forming the image by reacting with the developer oxidation product to yield a dye (conventionally yellow, magenta or cyan). The dyes sometimes have an unwanted secondary density.

Masking couplers are coloured products which also react with the developer oxidation product. Their intrinsic colour disappears as this reaction proceeds. Wherever possible, they are selected with an intrinsic colour corresponding to that of the unwanted secondary density of the actual coupler. The intrinsic colour of the masking coupler disappears by coupling, to the extent that the secondary density occurs, such that there is a constant density of this colour over the entire image area which may readily be filtered out.

Coupling of the masking coupler with the developer oxidation product additionally results in the production of a dye differing in colour from the intrinsic colour thereof, which dye is also used to form the image.

Masking couplers may be used in the layer which contains the actual colour coupler (which couples to yield a dye having the unwanted secondary density) or in an immediately adjacent layer.

Colour negative films conventionally contain on a transparent support, in the stated order, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. Layers of identical spectral sensitivity differ with regard to their photographic sensitivity, wherein the less sensitive partial layers are generally arranged closer to the support than the more sensitive partial layers.

Interlayers are conventionally provided between layers of differing spectral sensitivity, which interlayers are intended to prevent the diffusion of developer oxidation products from one layer of a certain spectral sensitivity into a layer of a different spectral sensitivity, as colour distortions would otherwise occur.

It has now surprisingly been found that introducing a masking coupler into an interlayer between a blue-sensitive and a green-sensitive silver halide emulsion layer and/or into an interlayer between a green-sensitive and a red-sensitive silver halide emulsion layer results in an increase in sensitivity if the masking coupler has a reaction rate of $\geqq 5000$ $1\text{-mol}^{-1}\bullet s^{-1}$, preferably of $\geqq 10000$ $1\text{-mol}^{-1}\bullet s^{-1}$.

The reaction rate constant is determined using the method described in U.S. Pat. No. 5,270,157.

The present invention accordingly provides a colour photographic silver halide material which contains on a support at least one red-sensitive, cyan-coupling, at least one green-sensitive, magenta-coupling and at least one blue-sensitive, yellow-coupling silver halide emulsion layer together with interlayers between layers of different colour sensitivity, wherein at least one of the stated interlayers contains at least one masking coupler, characterised in that the masking coupler has a reaction rate constant for the coupling reaction with the developer oxidation product of $\geqq 5000$ $1\text{-mol}^{-1}\bullet s^{-1}$.

The masking coupler is preferably introduced into the material in a quantity of 10 to 250 $\mu mol/m^2$.

In a preferred embodiment, a yellow-coloured, magenta-coupling masking coupler is introduced between a blue-sensitive and a green-sensitive layer.

In another preferred embodiment, a yellow-coloured, cyan-coupling masking coupler or, particularly preferably, a magenta-coloured, cyan-coupling masking coupler, is introduced between a green-sensitive and a red-sensitive layer.

The colour photographic material is in particular a colour negative film as described above.

A yellow filter layer which prevents blue light from reaching the underlying layers is usually arranged in such a film between the green-sensitive and blue-sensitive layers.

The number and arrangement of the photosensitive layers may be varied in order to achieve specific results. For example, all high sensitivity layers may be grouped together in one package of layers and all low sensitivity layers may be grouped together in another package of layers in order to increase sensitivity (DE 2 530 645).

Possible options for different layer arrangements and the effects thereof on photographic properties are described in *J. Inf. Rec. Mats.,* 1994, volume 22, pages 183–193.

The substantial constituents of the photographic emulsion layers are binder, silver halide grains and colour couplers.

Details of suitable binders may be found in *Research Disclosure* 37254, part 2 (1995), page 286.

Details of suitable silver halide emulsions, the production, ripening, stabilisation and spectral sensitisation thereof, including suitable spectral sensitisers, may be found in *Research Disclosure* 37254, part 3 (1995), page 286 and in *Research Disclosure* 37038, part XV (1995), page 89.

Colour negative films conventionally contain silver bromide-iodide emulsions which may optionally also contain small proportions of silver chloride.

Details relating to colour couplers may be found in *Research Disclosure* 37254, part 4 (1995), page 288 and in *Research Disclosure* 37038, part 11 (1995), page 80. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in *Research Disclosure* 37254, part 5 (1995), page 290 and in *Research Disclosure* 37038, part XIV (1995), page 86.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 $\mu m$ in diameter) in the layers.

Suitable high-boiling organic solvents, methods for the introduction thereof into the layers of a photographic material and further methods for introducing chemical compounds into photographic layers may be found in *Research Disclosure* 37254, part 6 (1995), page 292.

Suitable compounds (white couplers, scavengers or DOP scavengers) may be found in *Research Disclosure* 37254, part 7 (1995), page 292 and in *Research Disclosure* 37038, part III (1995), page 84.

The photographic material may also contain compounds which absorb UV light, optical brighteners, spacers, filter dyes, formalin scavengers, light stabilisers, anti-oxidants, $D_{min}$ dyes, additives to improve the stability of dyes, couplers and whites and to reduce colour fogging, plasticisers (latices), biocides and others.

Suitable compounds may be found in *Research Disclosure* 37254, part 8 (1995), page 292 and in *Research Disclosure* 37038, parts IV, V, VI, VII, X, XI and XIII (1995), pages 84 et seq..

The layers of colour photographic materials are conventionally hardened, i.e. the binder used, preferably gelatine, is crosslinked by appropriate chemical methods.

Suitable hardener substances may be found in *Research Disclosure* 37254, part 9 (1995), page 294 and in *Research Disclosure* 37038, part XII (1995), page 86.

Once exposed with an image, colour photographic materials are processed using different processes depending upon their nature. Details relating to processing methods and the necessary chemicals are disclosed in *Research Disclosure* 37254, part 10 (1995), page 294 and in *Research Disclosure* 37038S, parts XVI to XXIII (1995), pages 95 et seq. together with example materials.

The yellow filter layer conventionally contains yellow colloidal silver.

Colloidal silver results in unwanted centres of physical development during processing. Moreover, its absorption band is not ideal, as the long-wave flank does not fall off sufficiently sharply.

In another development of the invention, the interlayer between a green-sensitive and a blue-sensitive silver halide emulsion layer contains no silver and contains a yellow dye which is bleached or rinsed out of the photographic material after processing.

Examples of yellow filter dyes are:

GF-1

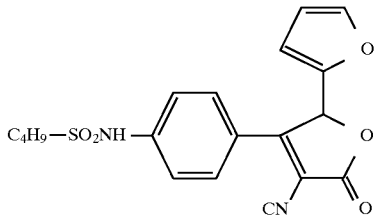

GF-2

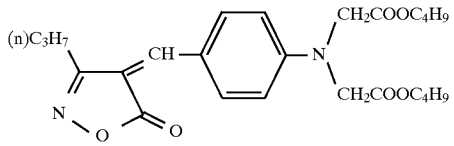

GF-3

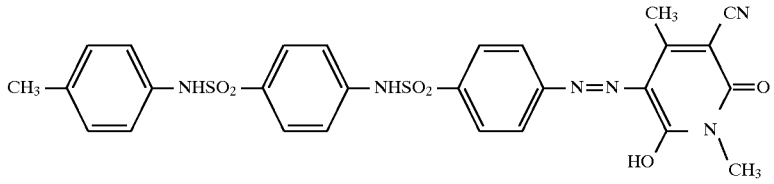

Examples of masking couplers are:

MK-1

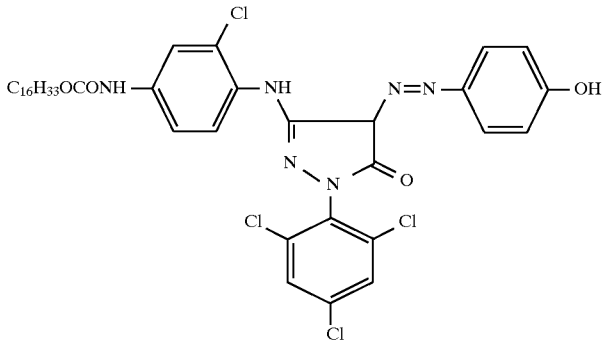

k = 13.000 $l.mol^{-1}.s^{-1}$

-continued
MK-2
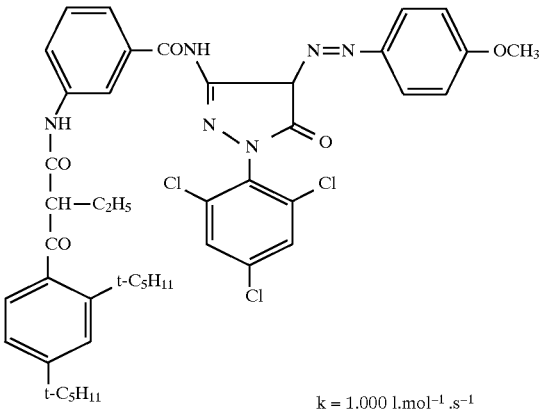
k = 1.000 $l.mol^{-1}.s^{-1}$
MK-3
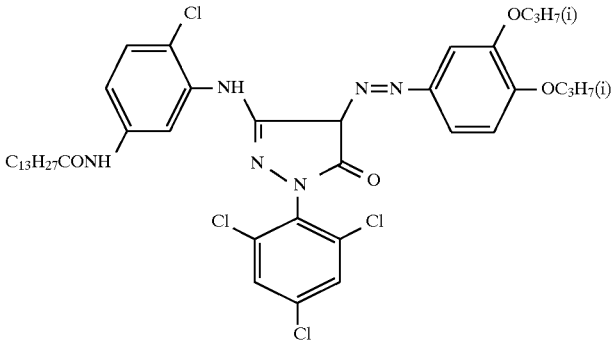
k = 2.400 $l.mol^{-1}.s^{-1}$
MK-4
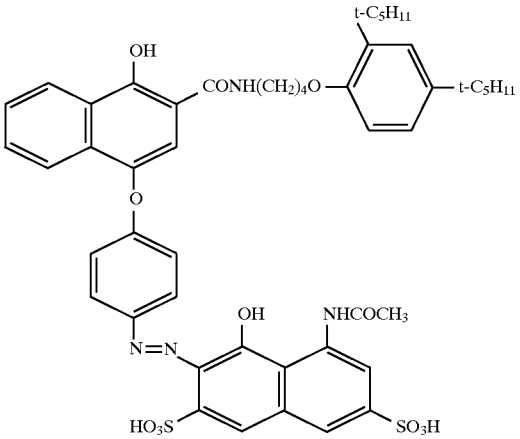
k = 15.000 $l.mol^{-1}.s^{-1}$ -continued

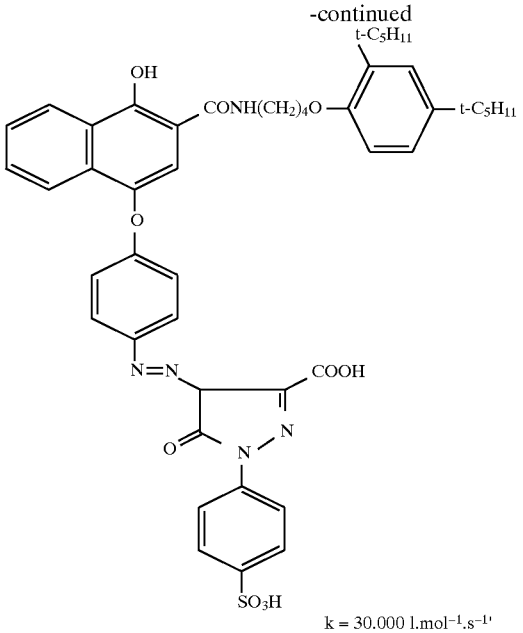

k = 30.000 l.mol$^{-1}$.s$^{-1}$

MK-5

EXAMPLE 1

A colour photographic recording material for colour negative development was produced (layer structure 1A) by applying the following layers in the stated sequence onto a transparent cellulose triacetate film base. All stated quantities relate to 1 m$^2$. The quantity of silver applied is stated as the corresponding quantities of $AgNO_3$; the silver halides are stabilised with 0.5 g of 4-hydroxy-6-methyl-1,3,3a,7-tetraazaindene per mol of $AgNO_3$.

1st layer (anti-halo layer)

0.3 g of black colloidal silver 1.2 g of gelatine 0.4 g of UV absorber UV I 0.02 g of tricresyl phosphate (TCP)

2nd layer (interlayer)

0.25 g of $AgNO_3$ of an AgBrI emulsion, average grain diameter 0.07 $\mu$m, 0.5 mol. % AgI 1.0 g of gelatine 3rd layer (low sensitivity red-sensitive layer)

2.7 g of $AgNO_3$ of a spectrally red-sensitised Ag(Br,l) emulsion with 4 mol. % iodide, average grain diameter 0.5 $\mu$m 2.0 g of gelatine 0.88 g of colourless coupler C-1

0.02 g of DIR coupler D-1

0.05 g of MK-4

0.07 g of MK-5

0.75 g of TCP

4th layer (high sensitivity red-sensitive layer)

2.2 g of $AgNO_3$ of spectrally red-sensitised Ag(Br,I) emulsion, 12 mol. % iodide, average grain diameter 1.0 $\mu$m 1.8 g of gelatine 0.19 g of colourless coupler C-2

0.17 g of TCP

5th layer (interlayer)

0.4 g of gelatine 0.15 g of white coupler W-1

6th layer (low sensitivity green-sensitive layer)

1.9 g of $AgNO_3$ of a spectrally green-sensitised Ag(Br,I) emulsion, 4 mol. % iodide, average grain diameter 0.35 $\mu$m 1.8 g of gelatine 0.54 g of colourless coupler M-1

0.24 g of DIR coupler D-1

0.065 g of coloured coupler YM-1

0.6 g of TCP

7th layer (high sensitivity green-sensitive layer)

1.25 g of $AgNO_3$ of a spectrally green-sensitised Ag(Br,I) emulsion, 9 mol. % iodide, average grain diameter 0.8 $\mu$m 1.1 g of gelatine 0.195 g of colourless coupler M-2

0.05 g of MK-1

0.245 g of TCP

8th layer (yellow filter layer)

0.09 g of yellow colloidal silver 0.25 g of gelatine 0.08 g of scavenger SCI 0.40 g of formaldehyde scavenger FF-1

0.08g of TCP

9th layer (low sensitivity blue-sensitive layer)

0.9 g of a spectrally blue-sensitised Ag(Br,I) emulsion, 6 mol. % iodide, average grain diameter 0.6 $\mu$m 2.2 g of gelatine 1.1 g of colourless coupler Y-1

0.037 g of DIR coupler D-1

1.14 g of TCP

10th layer (high sensitivity blue-sensitive layer)

0.6 g of $AgNO_3$ of a spectrally blue-sensitised Ag(Br,I) emulsion, 10 mol. % iodide, average grain diameter 1.2 $\mu$m 0.6 g of gelatine 0.2 g of colourless coupler Y-1

0.003 g of DIR coupler D-1

0.22 g of TCP
11th layer (micrate layer)
0.06 g of $AgNO_3$ of a micrate Ag(Br,I) emulsion, average grain diameter 0.06 $\mu$m, 0.5 mol.% iodide
1 g of gelatine
0.3 g of UV absorber UV-2
0.3 g of TCP
12th layer (protective & hardening layer)
0.25 g of gelatine
0.75 g of hardener of the formula
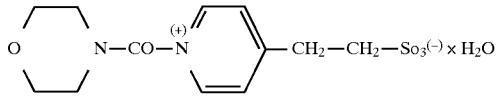
such that, once hardened, the total layer structure had a swelling factor of ≦3.5.
Substances used in Example 1:
UV-1
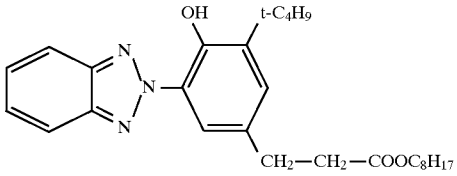
UV-2
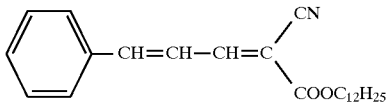
C-1
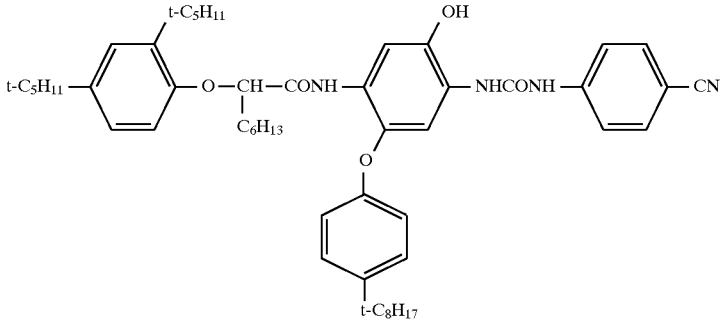
C-2
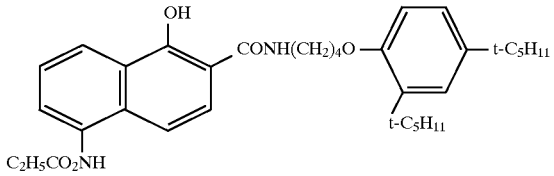
M-1
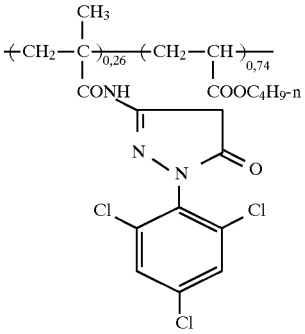
M-2
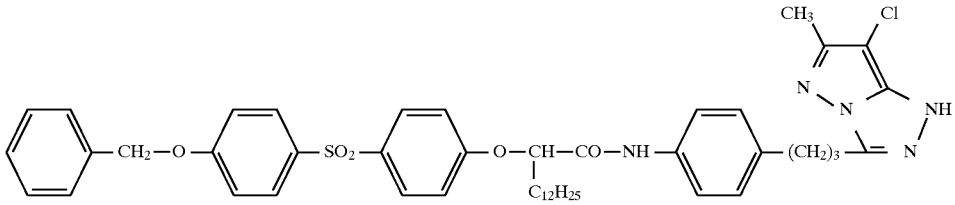

-continued
YM-1
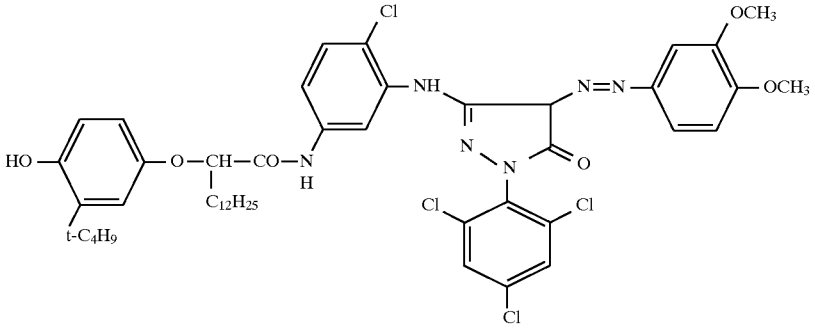
Y-1
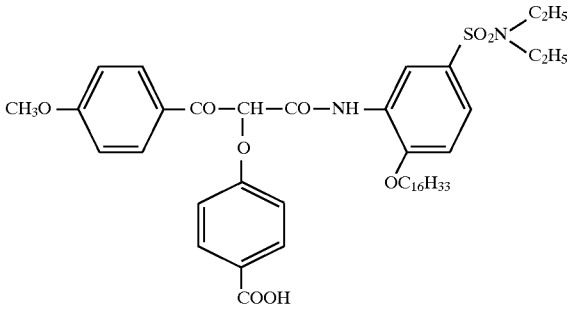
D-1
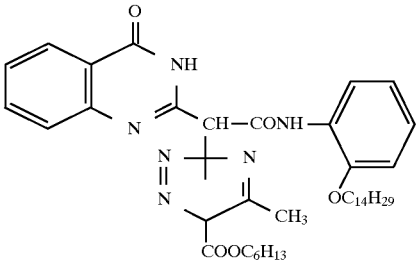
SC-1
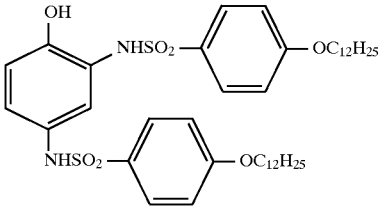
FF-1
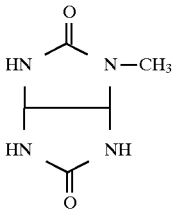
W-1
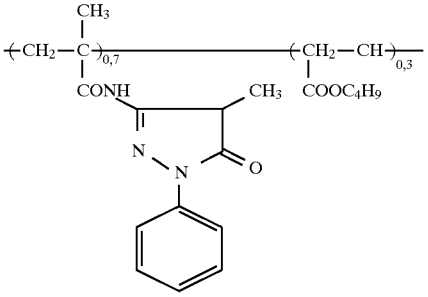

After being exposed with a grey wedge, the material is processed using a colour negative process described in *the British Journal of Photography,* 1974, pages 597 and 598.

In layer structure 1B, the 8th layer is of the following composition:

8th layer (yellow filter layer)

0.25 g of gelatine 0.05 g of yellow dye GF-1

0.08 g of scavenger SC-1

0.40 g of formaldehyde scavenger FF-1

0.08 g of TCP

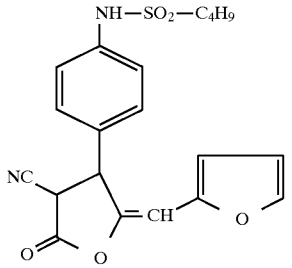

GF-1

In layer structure 1C, the 7th layer is of the following composition:

7th layer (high sensitivity green-sensitive layer)

1.25 g of $AgNO_3$ of a spectrally green-sensitised Ag(Br,I) emulsion, 9 mol. % iodide, average grain diameter 0.8 $\mu$m 1.1 g of gelatine 0.195 g of colourless coupler M-2

0.05g of MK-2

0.245 g of TCP

In layer structures 1D and 1E, NK-1 was omitted from the 7th layer. Table 1 shows further differences in formulation and the results.

TABLE 1

| Material | Masking coupler in 8th layer | Relative green sensitivity | Magenta granularity*) | Blue/green colour separation**) [°DIN] | |
|---|---|---|---|---|---|
| 1A | — | 100 | 20 | 10 | Comparison |
| 1B | — | 98 | 20 | 12 | Comparison |
| 1C | — | 118 | 23 | 10 | Comparison |
| 1D | 0.05 g/m$^2$ MK-2 | 100 | 19 | 12 | Comparison |
| 1E | 0.05 g/m$^2$ MK-1 | 114 | 20 | 12 | Invention |

*)Granularity (RMS) at density 0.4 above fog, values × 1000

**)Blue/green colour separation is the difference in green sensitivity on exposure with white light and on exposure with blue light, with exposure being standardised to the identical blue sensitivity. The higher is the value, the greater is the colour saturation.

As can be seen, sensitivity is improved in the materials according to the invention without degradation of granularity and with increased colour separation.

EXAMPLE 2

The 5th layer of layer structure 2B additionally contains 0.06 g/m$^2$ of aurintricarboxylic acid aluminium salt; layer structure 2C differs from layer structure 1A by the addition of 0.045 g/m$^2$ of MK-4 to the 5th layer.

Table 2 shows the results.

TABLE 2

| Material | Relative red sensitivity | Cyan granularity*) | Green/red colour separation**) | |
|---|---|---|---|---|
| 1A | 100 | 13 | 16 | Comparison |
| 2B | 99 | 13 | 18 | Comparison |
| 2C | 107 | 13 | 18.5 | Invention |

*)Granularity (RMS) at density 0.4 above fog, values × 1000

**)Green/red colour separation is the difference in red sensitivity on exposure with white light and on exposure with green light, with exposure being standardised to the identical green sensitivity. The higher is the value, the greater is the colour saturation.

As can be seen, red sensitivity and green/red colour separation are improved in the materials according to the invention without degradation of cyan granularity.

We claim:

1. A color photographic silver halide material which comprises on a support at least one red-sensitive, cyan-coupling, at least one green-sensitive, magenta-coupling and at least one blue-sensitive, yellow-coupling silver halide emulsion layer together with interlayers between layers of different color sensitivity, wherein at least one of the stated interlayers contains at least one masking coupler, and said masking coupler has a reaction rate constant for the coupling reaction with the developer oxidation product of ≧5000 1-mol$^{-1}$-s-1.

2. The color photographic silver halide material as claimed in claim 1, wherein the reaction rate constant is >10000 1-mol$^{-1}$s-1.

3. The color photographic silver halide material as claimed in claim 1, wherein said masking coupler is present in the quantity of 10 to 250 $\mu$mol/m$^2$.

4. The color photographic silver halide material as claimed in claim 1, wherein said masking coupler is between a blue-sensitive and green- sensitive layer.

5. The color photographic silver halide material as claimed in claim 4, wherein said masking coupler is a yellow-colored or magenta colored coupling masking coupler.

6. The color photographic silver halide material as claimed in claim 1, wherein said masking coupler is between the green-sensitive and the red-sensitive layers.

7. The color photographic silver halide material as claimed in claim 6, wherein said masking coupler is a magenta-colored, cyan-coupling masking coupler.

8. The color photographic silver halide material, as claimed in claim 1, wherein the color photographic material is a color negative film.

9. The color photographic silver halide material as claimed in claim 1, wherein a yellow filter layer is arranged between the green-sensitive and blue-sensitive layers.

10. The color photographic silver halide material as claimed in claim 9, wherein said yellow filter layer contains a dye selected from the group consisting of

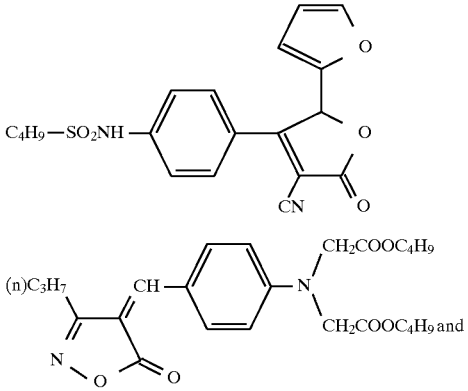
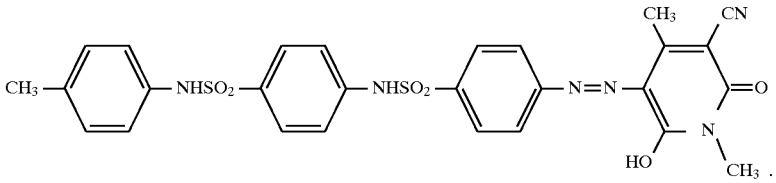
11. The color photographic silver halide material as claimed in claim 1, wherein said masking couplers are selected from the group consisting of
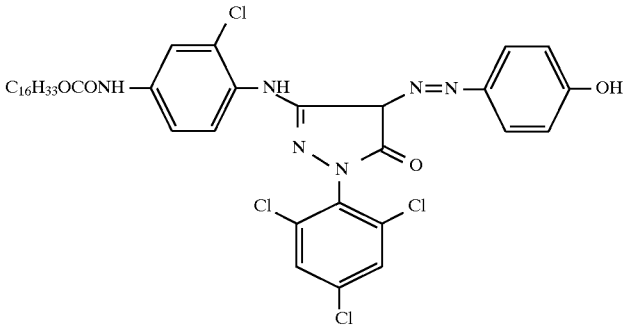
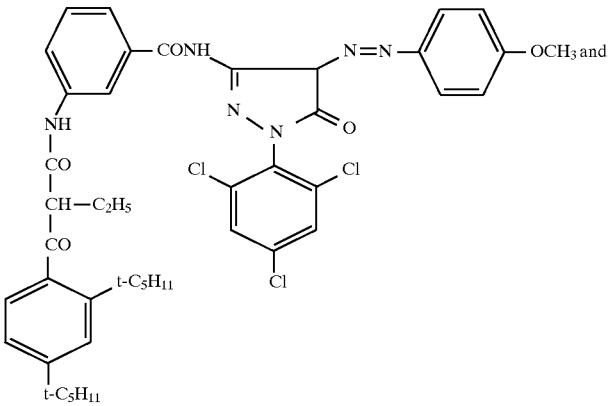

-continued
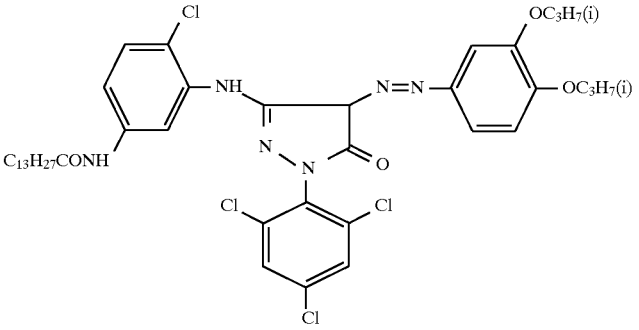
15
* * * * *